US005688077A

United States Patent [19]

Kynoch

[11] Patent Number: 5,688,077

[45] Date of Patent: Nov. 18, 1997

[54] ROCK ANCHOR BOLT

[75] Inventor: Kenneth Douglas Kynoch, Cape Town, South Africa

[73] Assignee: Cape Town Iron and Steel Works (PTY) Limited, South Africa

[21] Appl. No.: 297,658

[22] Filed: Aug. 29, 1994

[30] Foreign Application Priority Data

Aug. 30, 1993 [ZA] South Africa ..... 93/6353

[51] Int. Cl.[6] ..... F21D 21/00

[52] U.S. Cl. ..... 405/259.5; 405/259.1

[58] Field of Search ..... 405/259.1–259.6

[56] References Cited

U.S. PATENT DOCUMENTS

| | | | |
|---|---|---|---|
| 4,247,223 | 1/1981 | Amakasv | 405/259.1 |
| 4,284,379 | 8/1981 | Chaiko | 405/259.3 X |
| 4,307,979 | 12/1981 | Killmeyer | 405/259.1 |
| 4,325,657 | 4/1982 | Elders | 405/259.1 X |
| 4,350,462 | 9/1982 | Elders | 405/259.3 |
| 4,511,289 | 4/1985 | Herron | 405/259.1 X |
| 5,054,146 | 10/1991 | Wiesenfeld et al. | 405/257.6 X |
| 5,192,169 | 3/1993 | Landsberg | 405/259.1 |
| 5,297,700 | 3/1994 | Witzand | 405/259.3 |

FOREIGN PATENT DOCUMENTS

| | | | |
|---|---|---|---|
| 630660 | 8/1991 | Australia | 405/259.5 |

*Primary Examiner*—Frank Tsay
*Assistant Examiner*—Frederick L. Lagman
*Attorney, Agent, or Firm*—Banner & Witcoff, Ltd.

[57] ABSTRACT

A rock anchor bolt (18) comprising an elongated rod (10, 12, 14, 16, 18) which is provided over its outer surface with at least one (11), two (13), three, (17) or four (15) axially extending grooves. The rod (10, 12, 14, 16, 18), is preferably twisted over its length and provided over one of its ends (22) with screw threads (23) in order to receive a cooperating nut (25).

11 Claims, 5 Drawing Sheets

FIG.1
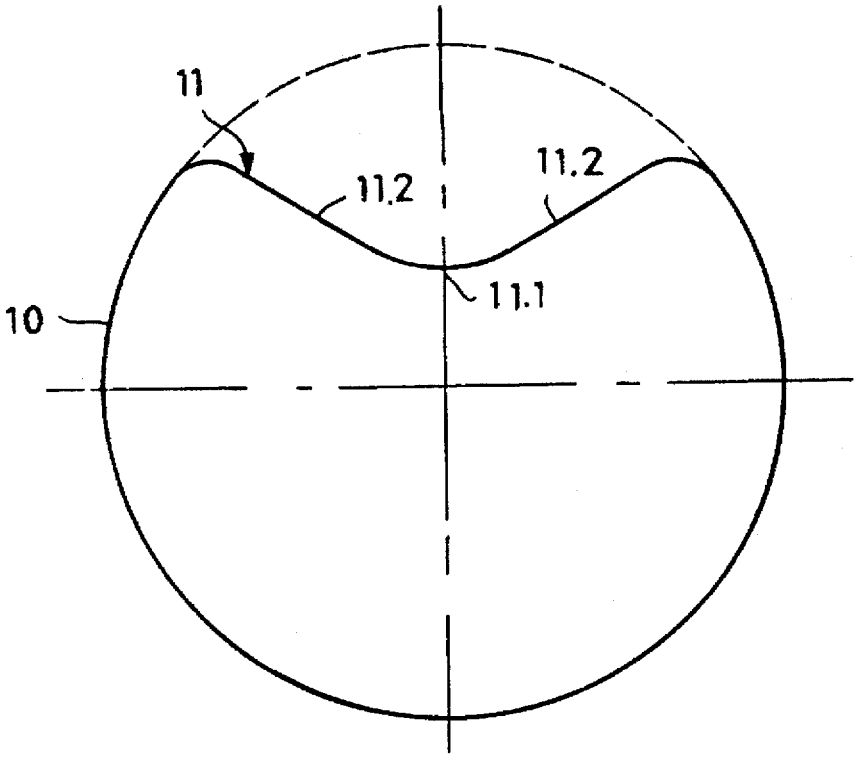
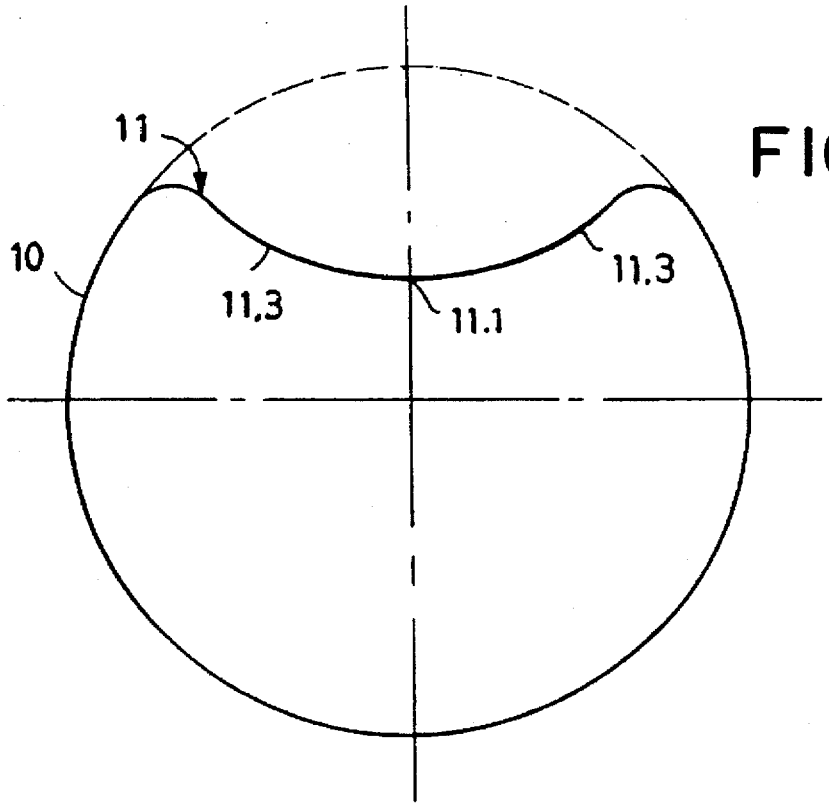
FIG.2

ROCK ANCHOR BOLT

BACKGROUND OF THE INVENTION

This invention relates to rock anchor bolts.

It is known to provide a rock anchor bolt which comprises an elongated metal rod of square configuration in cross section which is twisted over its length, with the one end being threaded to receive a cooperating nut or the like.

Such rock anchor bots are, for example, used in mining or tunneling operations where they are locked into holes in the rock face to stabilize an overhanging or side rock wall or the like.

Usually that end of the rod opposite the threaded one is adapted to cooperate with a settable material located in the drilled hole in the rock face which, on setting, serves to anchor the bolt to the rock face. For this purpose the said end may be provided with a head or the like intended to cooperate with such settable material.

The known rock anchor bolts of the aforesaid type all suffer from some disadvantage or another, and it is an object of this invention to provide a rock anchor bolt which the applicant believes overcomes or at least minimises such disadvantages.

According to the invention a rock anchor bolt comprises an elongated metal rod which is provided over its outer surface with at least one, axially extending groove.

Preferably the rod includes one, two, three or four such grooves.

It will be appreciated that the presence of such grooves effectively increases the cross sectional circumference of the rod in the area of the grooves thus providing a larger surface for cooperating with a settable material located in the hole into which the bolt is to be inserted.

Where more than one groove is employed, the grooves are preferably arranged symmetrically about the circumference of the rod.

It will be appreciated that the more grooves present, the larger the cross sectional circumference of the rod in that area.

On the other hand, it will also be appreciated that since the presence of such grooves can weaken the tensile strength of the rod, a compromise is necessary in respect of the number of grooves (and their depths) employed relative to the cross sectional width of the rod.

The rod may be of any suitable overall configuration in cross section.

Preferably the rod is of either circular or square configuration in cross section.

Further according to the invention at least part of the profile of the groove is of curved configuration in cross section.

Preferably the profile of at least the valley of the groove is of curved configuration in cross section.

In one form of the invention the side walls of the groove may also be of curved configuration in cross section.

In another form of the invention at least part of the side walls of the groove is of straight configuration in cross section.

The grooves may be provided in any suitable manner in the surface of the rod.

Thus, for example, they may be rolled into the rod material.

Preferably at least part of the grooved rod is twisted about its longitudinal axis and at least one of its ends is provided with screw threads adapted to receive a cooperating nut or the like.

It will be appreciated that with the rod so twisted, the aforesaid grooves extend helically about the rod's longitudinal axis.

Apart from facilitating the gripping action of such a grooved rod on the set material in the drilled hole, rotation of the rod when the rod is being inserted into the hole also facilitates the mixing of the settable material in the hole.

It will be appreciated that where the rod is of circular configuration, it faciltates the rolling of such a rod in order, for example, to provide such grooves and/or threads therein with a conventional type of rolling apparatus.

The rod may be of any suitable material as is conventional for such rods such as, for example, steel.

BRIEF DESCRIPTION OF THE DRAWINGS

The invention will now be described further by way of example with reference to the enclosed drawings, of which;

FIGS. 1 to 8 are all cross sectional views of different embodiments of rods for rock anchor bolts according to the invention.

DETAILED DESCRIPTION OF THE PRESENT INVENTION

Figure 3:
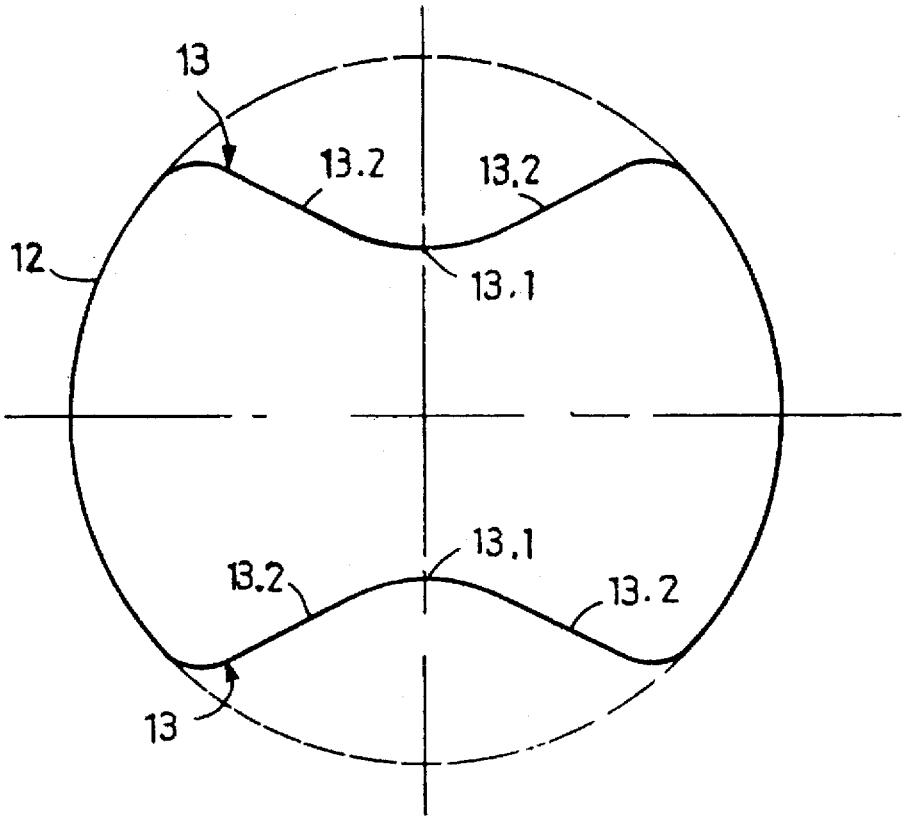

In the embodiment shown in FIGS. 1 and 2, the rod 10 is of general circular configuration in cross section and provided with a single longitudinally extending groove 11 of which at least the valley 11.1 is of substantially semi-circular configuration in cross section, with the radius of curvature being different in each of the two embodiments. In the embodiment shown in FIG. 1, at least part of the side walls 11.2 of groove 11 is of straight configuration, while in the embodiment shown in FIG. 2, side walls 11.3 of groove 11 are of curved configuration, the angle of curvature being the same as that of valley 11.1. The generally circular outer surface of the rod 10 includes a circumferential outer section 11.4, which corresponds to the outer surface less the width of the groove 11.

Figure 4:
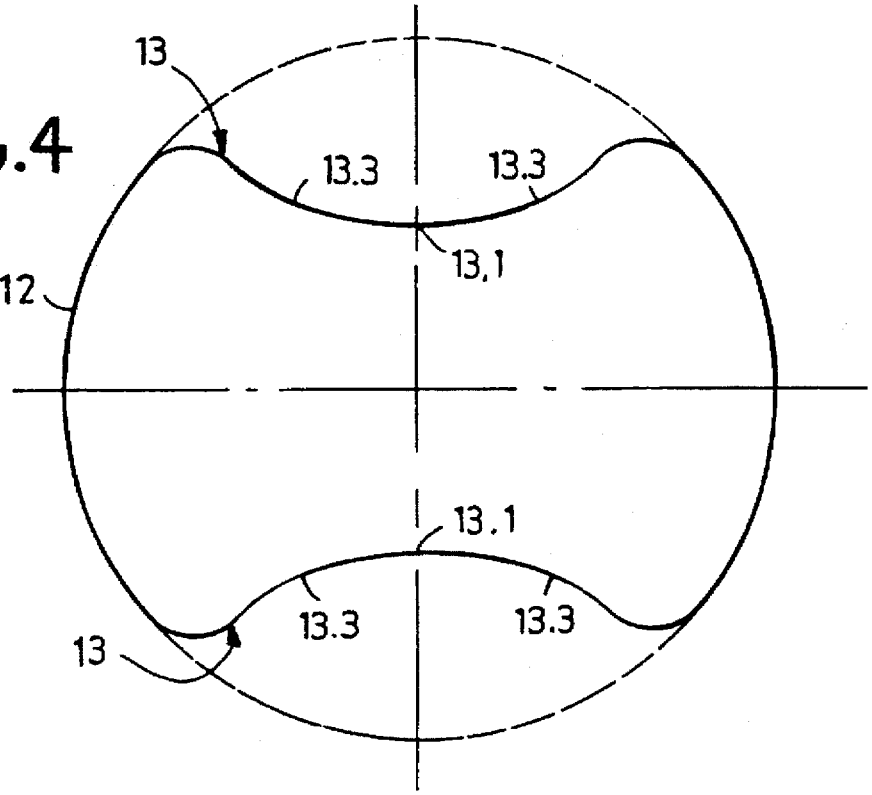

In the embodiments shown in FIGS. 3 and 4, the rod 12, which is also of general circular configuration in cross section, is provided with two diametrically opposed longitudinally extending grooves 13, of which at least the valleys 13.1 are of substantially semi-circular configuration in cross section, with the radius of curvature being different in each of the embodiments. In the embodiment shown in FIG. 3, at least part of the side walls 13.2 of each groove 13 is of straight configuration, while in the embodiment shown in FIG. 4, side walls 13.3 of groove 13 are of curved configuration, the angle of curvature being the same as that of the valleys 13.1.

Figure 5:
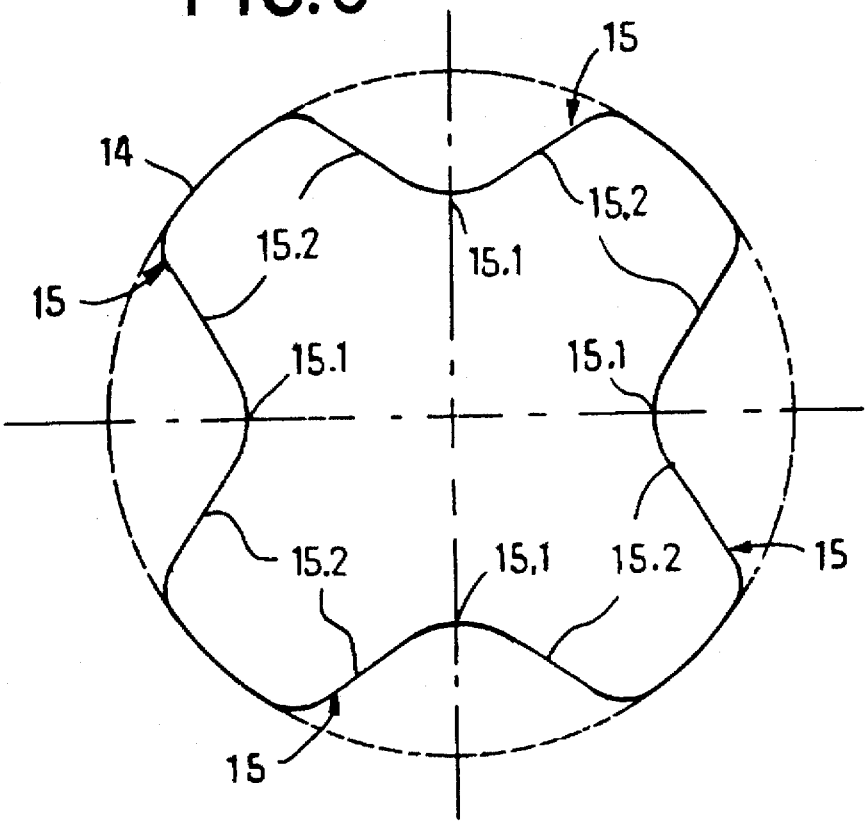
Figure 6:
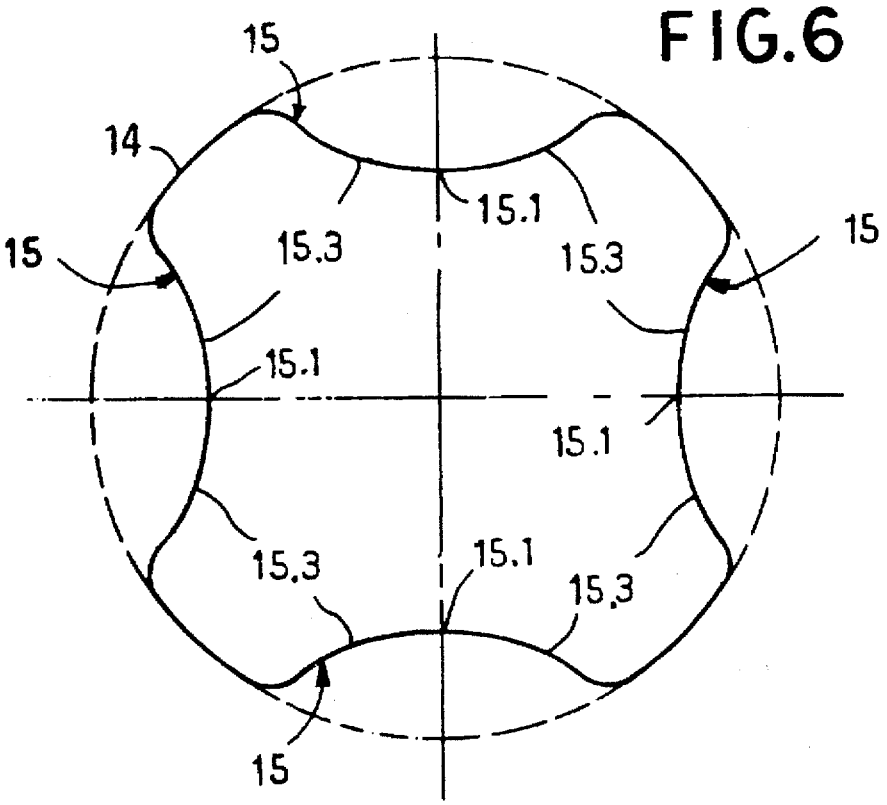

In the embodiment shown in FIGS. 5 and 6, the rod 14, which is also of general circular configuration in cross section, is provided with four longitudinally extending grooves 15 which are symmetrically arranged about the circumference of rod 14 and of which the valleys 15.1 are all of substantially semi-circular configuration in cross section, with the radius of curvature being different in each of the two embodiments. In the embodiment shown in FIG. 5, at least part of the side walls 15.2 of each groove 15 is of straight configuration, while in the embodiment shown in FIG. 6, side walls 15.3 of groove 15 are of curved configuration, the angle of curvature being the same as that of valleys 15.1. The generally circular outer surface of the rod 14 includes a plurality of circumferential outer sections 15.4, which are between the grooves 15.

Figure 7:
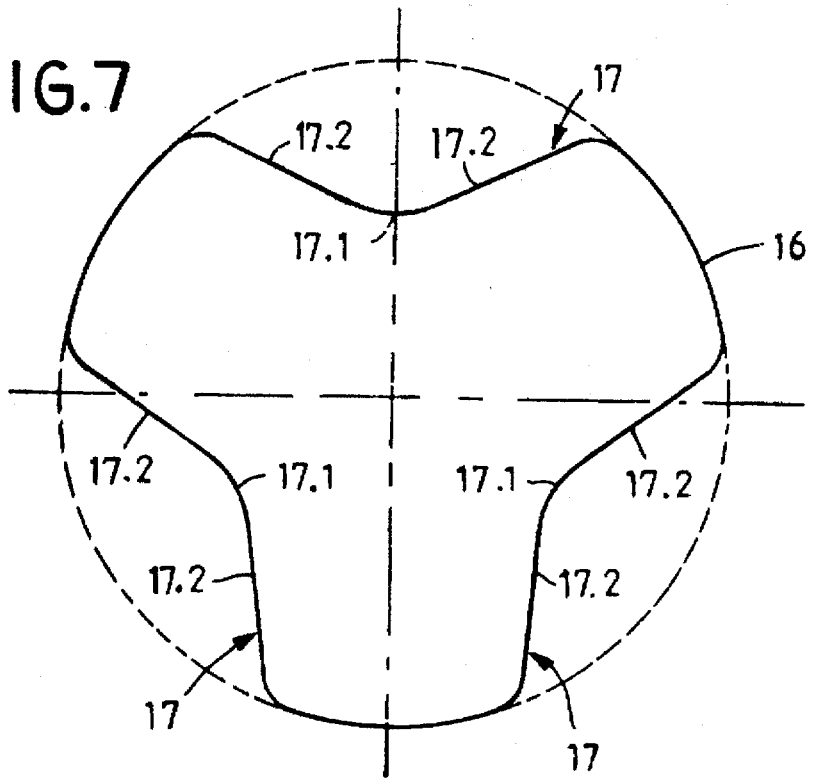
Figure 8:
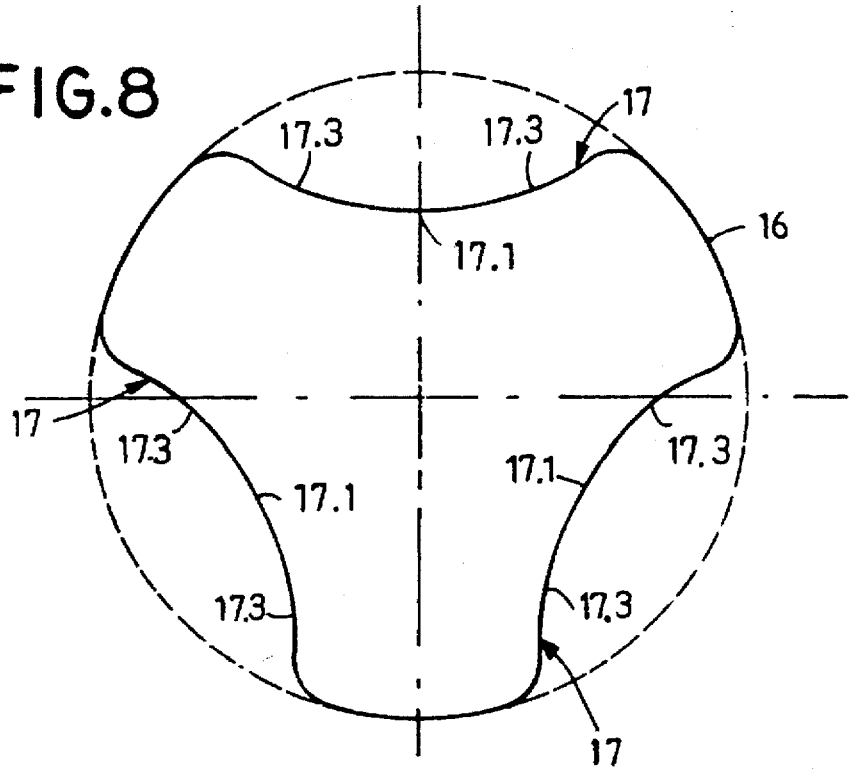

In the embodiment shown in FIGS. 7 and 8, the rod 16, which is also of general circular configuration in cross section, is provided with three longitudinally extending grooves 17 which are symmetrically arranged about the circumference of rod 16 and of which the valleys 17.1 are all of substantially semi-circular configuration in cross section, with the radius of curvature being different in each of the two embodiments. In the embodiment shown in FIG. 7, at least part of the side walls 17.2 of each groove 17 is of straight configuration, while in the embodiment shown in FIG. 8, side walls 17.3 of groove 17 are of curved configuration, the angle of curvature being the same as that of valleys 17.1.

It will be appreciated that the grooves can extend for any predetermined suitable distance over the length of the rods and, if required, a groove may also extend intermittently over the length of the rod.

It will be appreciated further that the rod may be twisted relative to its longitudinal axis, and provided with screw threads, an anchor head, etc., as is conventional for rock anchor bolts.

Figure 9:
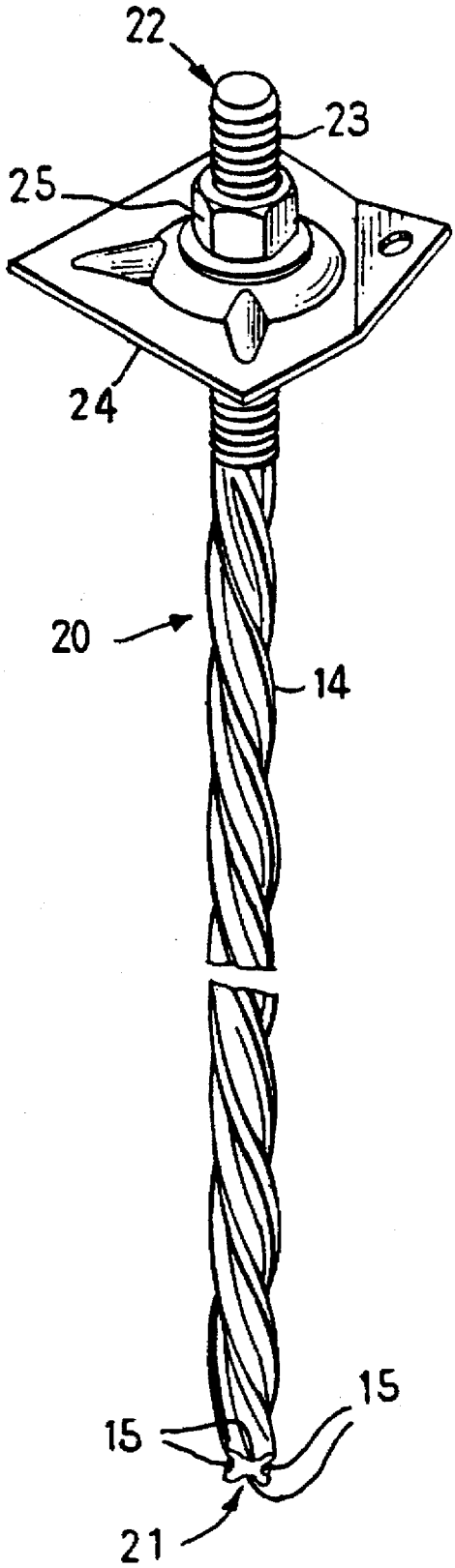
FIG. 9 is a diagrammatic perspective view of a rock anchor bolt with a rod comprising the embodiment shown in FIG. 5.

In FIG. 9 a rock anchor bolt 20 is shown of which the rod 14, is of the configuration shown in FIG. 5, i.e. provided with four longitudinally extending grooves 15 which are symmetrically spaced about the circumference of rod 20.

Rod 14, which can be of any suitable metal as is conventional for such rods, and of a length which is determined by the particular application for which anchot bolt 20 is intended, has its one end 21 cut at an angle in the order of 45° to define a sharp edge.

The other end 22 of rod 14 is provided with a screw thread 23 which extends for a short distance along the length of rod 14.

Because rod 14 is of substantially circular configuration in cross section, grooves 15 and screw thread 23 may be provided in it by means of a conventional type of rolling apparatus.

A domed, ribbed 'dog-eared' washer 24 with a locking nut 25 is rotatably received on the screw threads 23 of rod 14.

Rod 14 is twisted over its length so that grooves 15 extend helically around rod 14 in a radial direction opposite to that of screw threads 23 to ensure good mixing and reduced spillings of the settable material by the Archimedes screw effect when anchor bolt 20 is rotated during its insertion into the hole into which it is being anchored.

Some of the other details of anchor bolt 20 are as follows:

| | |
|---|---|
| Rod 14's outer diameter (mm): | 18 |
| Thread 23's major diameter (mm): | 18 |
| Thread 23's pitch (mm): | 2,5 |
| Nut 25's length (mm): | 25 |
| Nut 25's type: | PLAIN |
| Nut 25's hex size across flats (mm): | 27 |
| Nut 25's locking for bar spining: | SHEARPIN |
| Bolt 20's breaking strenth (kN): | 110 |
| Rod 14's breaking strength (kN): | 125 |

As will be appreciated, there are no doubt many variations in detail possible with a rock anchor bolt according to the invention without departing from the spirit and/or scope of the claims.

I claim:

1. A rock anchor bolt adapted for use with a settable material which is provided in a preformed hole, said bolt comprising an elongated metal rod which in transverse cross section defines a circle and which is provided over the outer surface with at least one axially extending groove formed therein, the groove providing an extended surface area for cooperating with the settable material in the preformed hole, at least part of the rod bearing the groove being twisted about its longitudinal axis, said outer surface of the elongated rod including at least one circumferential outer section having a curvature corresponding to that of said circle, whereby the insertion of said elongated rod into said preformed hole facilitates the mixing of the settable material in said preformed hole.

2. The rock anchor bolt of claim 1 which includes more than one such groove, the grooves being arranged symmetrically about the circumference of the rod.

3. The rock anchor bolt of claim 1 of which the profile of at least the valley of a groove is of curved configuration in cross section.

4. The rock anchor bolt of claim 1 of which at least one groove is rolled into the rod material.

5. The rock anchor bolt of claim 1 of which at least one of the ends of the rod is provided with a screw thread adapted to receive a cooperating nut.

6. The rock anchor bolt of claim 5 wherein each screw thread is rolled into the twisted rod material.

7. The rock anchor bolt of claim 1 of which the rod has two diametrically opposed axially extending grooves.

8. The rock anchor bolt of claim 1 of which the rod has three axially extending grooves arranged symmetrically about the rod.

9. The rock anchor bolt of claim 1 of which the rock has four axially extending grooves arranged symmetrically about the rod.

10. The rock anchor bolt of claim 1 of which each groove extends over the entire length of the rod and the rod is twisted over its entire length.

11. A rock anchor bolt adapted for use with a settable material which is provided in a preformed hole, said bolt comprising an elongated metal rod which in transverse cross section defines a circle and which is provided over its outer surface with four axially extending grooves formed therein, which are arranged symmetrically about the rod, and which extend over the entire length of the rod, the rod being twisted about its longitudinal axis over its entire length, the grooves providing an extended surface area for cooperating with the settable material in the preformed hole, and the outer surface including circumferential outer sections, each having a curvature corresponding to that of said circle, whereby the insertion of the elongated rod into said preformed hole facilitates the mixing of the settable material in said preformed hole.

* * * * *